US005492405A

United States Patent [19]

Meyer

[11] Patent Number: 5,492,405

[45] Date of Patent: Feb. 20, 1996

[54] DEVICE FOR THE PROPULSION OF AN OLOID SHAPED TUMBLER BODY

[76] Inventor: Pio Meyer, Sagenrainstrasse 7, CH-8636 Wald, Switzerland

[21] Appl. No.: 211,200

[22] PCT Filed: May 27, 1993

[86] PCT No.: PCT/CH93/00136

§ 371 Date: Jun. 17, 1994

§ 102(e) Date: Mar. 18, 1994

[87] PCT Pub. No.: WO94/02236

PCT Pub. Date: Feb. 3, 1994

[30] Foreign Application Priority Data

Jul. 20, 1992 [CH] Switzerland ..... 2261/92

[51] Int. Cl.[6] ..... B01F 9/00

[52] U.S. Cl. ..... 366/208; 366/219; 366/233

[58] Field of Search ..... 366/53, 55, 62, 366/63, 208, 211, 219, 233; 451/326–330; 74/60, 61, 86

[56] References Cited

U.S. PATENT DOCUMENTS

| | | | |
|---|---|---|---|
| 2,302,804 | 11/1942 | Schatz | 366/209 |
| 2,991,657 | 7/1961 | Schatz . | |
| 3,186,243 | 6/1965 | Urban . | |
| 3,610,587 | 10/1971 | Schatz . | |
| 3,824,866 | 7/1974 | Schatz | 74/61 |
| 4,341,475 | 7/1982 | Saladin | 366/211 |
| 4,669,225 | 6/1987 | Kuster | 366/219 X |
| 5,360,265 | 11/1994 | Cruse | 366/208 |

FOREIGN PATENT DOCUMENTS

| | | | |
|---|---|---|---|
| 2181375 | 11/1973 | France . | |
| 3542285 | 8/1986 | Germany . | |
| 242218 | 9/1946 | Switzerland | 74/86 |
| 500000 | 12/1970 | Switzerland . | |
| 1197713 | 12/1985 | U.S.S.R. . | |
| 1607922 | 11/1990 | U.S.S.R. | 366/219 |

*Primary Examiner*—Charles E. Cooley
*Attorney, Agent, or Firm*—Jenkens & Gilchrist

[57] ABSTRACT

An oloid-shaped body is placed on either a roller carpet or a free moving conveyor belt. The embodiments of the oloid-shaped body are a hollow body with a closeable opening and a skeleton body for attachment of vessels. A shaft is attached to the oloid-shaped body and has the position and direction of the longitudinal axis of the oloid-shaped body. A hollow shaft allows access to the oloid-shaped body during movement. A frame is positioned on either side of the conveyor belt, with a plurality of spring attachments connecting an oval guiding rail to each of the frames. A carriage runs around each of the guiding rails and guides an end of the shaft in an oval path. Drive units have drive chains which run around a path in each of the guiding rails and attaches to each of the carriages. In this manner, the drive units cause the carriages to move the shaft, thereby causing the oloid-shaped body to tumble in a stationary manner. A controlled power supply drives the drive units according to a position speed profile stored therein. An alternative to using the combination of using the guiding rails, carriages, and drives is the use of vertical and horizontal slides, each driven by a controlled drive so as to cause the shaft ends to rotate in the same rotational path, but in different directions.

25 Claims, 6 Drawing Sheets

DEVICE FOR THE PROPULSION OF AN OLOID SHAPED TUMBLER BODY

BACKGROUND OF THE INVENTION

1. Field of the Invention

The present invention relates to a device for the propulsion of a tumbler body and, more particularly, to a device for the propulsion of a tumbler body in the shape of an oloid.

2. History of the Related Art

CH-patent 500 000 describes a device for the generation of a tumbling motion. This device consists of a body that Paul Schatz, in his book "Rhythmusforschung und Technik," (Stuttgart 1975), refers to as an "oloid." This oloid, according to CH-A1 500 000, is driven by a conveyor belt which carries the oloid. This drive was not very popular in practical applications, because it requires a perfectly shaped oloid and no slip during the rolling of the oloid. Guide rollers, which are commonly used on drum-shaped rolling elements, cannot be used with the shape of the oloid. Even though it has, much like a cylinder, a straight contact line on one plane, the angle of this contact line changes in an oscillatory manner with respect to the direction of travel. Therefore, the invention never became successful. This is not the case with the solution presented in CH-patent 216 760 in which a hollow body, executing a tumbling motion, is part of a half Bricard chain. This solution has been successful in the market employing various designs and different means of propulsion. But it has the tremendous disadvantage that prevents the construction of a mixer based on the oloid or inversion principle with a capacity of one or more cubic meters. This disadvantage is caused by the high mass forces occurring during operation that constantly change in size and direction. These mass forces require extremely large components and, thus, represent extreme challenges to the base of such a machine.

The purpose of this invention is the creation of a drive for an oloid body that overcomes these disadvantages and is also suited for oloids with large dimensions.

SUMMARY OF THE INVENTION

The present invention relates to a device for the propulsion of a tumbler body. More particularly, one aspect of the invention comprises a device for the propulsion of a tumbler body in the shape of an oloid characterized by a shaft attached to this tumbler body exhibiting the direction and position of its longitudinal axis. Means are provided to guide and drive the trace points of the axis of the shaft through two parallel planes on each side of the tumbler body and defining its direction of movement on oval paths, with the movements of the trace points of the axis of the shaft through the two planes in the same rotating direction but basically against each other. The tumbler body is also positioned on a passively driven base.

In another aspect, the above described invention includes the device described above wherein the means necessary to guide the trace points of the axis of the shaft with the two parallel planes on oval paths consist in the fact that an oval guiding rail is present in both planes and that this rail is connected to a frame by at least four spring attachments which allow for a vertical movement. A carriage is attached to each guiding rail that can travel along these guiding rails and each carriage consisting of a frame carrying at least two guiding wheels is responsible for the friction-type and positive connection with the guiding rail, and a rotary joint on the frame, whose rotary axis is perpendicular to the tangent at the guiding rail and lies in its plane with its rotary part being a plate rotating by means of a rotary joint carrying a crossbeam parallel to the direction of the tangent at the guiding rail. The invention is further characterized by the presence of a guiding element in which the shaft can execute longitudinal and rotary motions and that can be swivelled around the mentioned crossbeam at the plate. The dimensions of the guiding rail, carriage with rotary joint, plate, and guiding element are designed so that the trace points of the axis of the shaft describe the intended oval curve in the planes when the tumbler body is moved by its base. Each carriage is connected by a pin to a roller in a roller chain with the rollers running in the guiding rails and the roller chains are driven by a driving gear integrated into the guiding rails that receives its driving torque from an engine via a transmission. Each engine is driven by means of a controlled power supply.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1A:
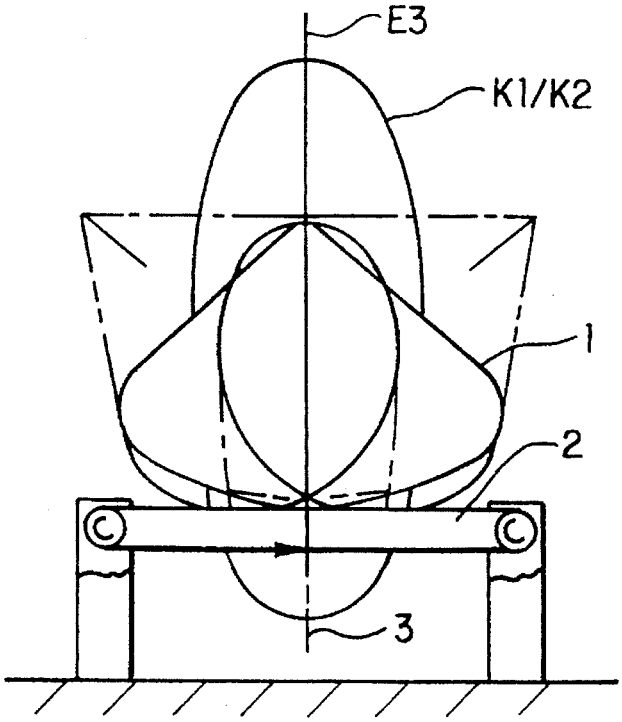
FIG. 1*a* and FIG. 1*b* are diagrams of the geometric relationship of an oloid during movement.
Figure 1B:
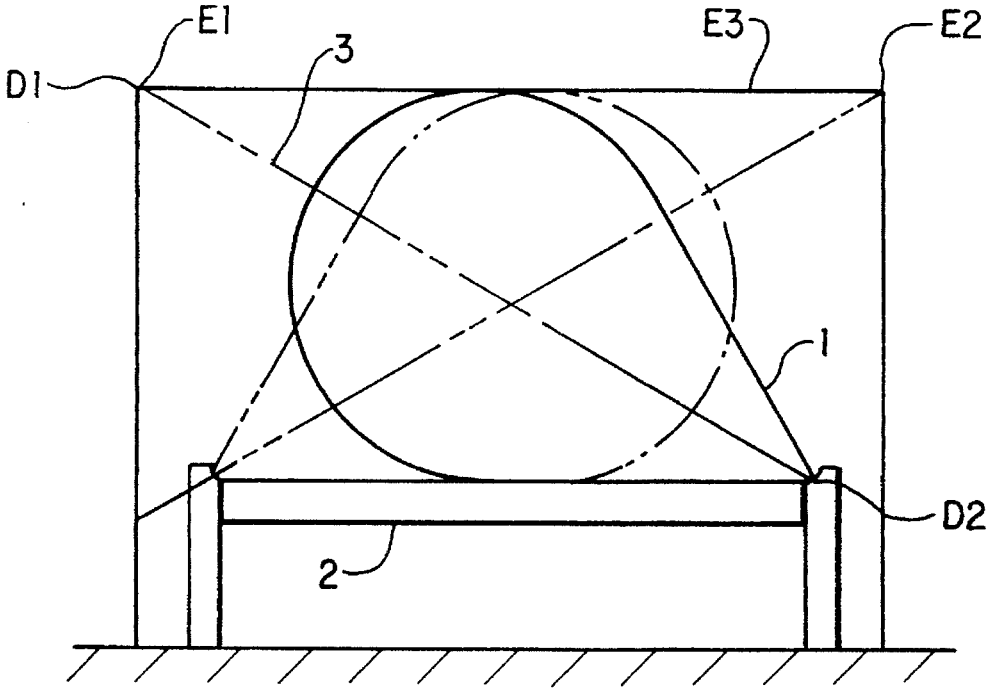

FIG. 1*a* and 1*b* illustrate an oloid 1 in different positions on a conveyor belt 2, which moves in the direction indicated by the arrows with uniform motion. If the tumbling motion of the oloid 1 takes place in such a manner that the center of gravity remains in a plane $E_3$ perpendicular to the conveyor belt 2, the trace points $D_1$, $D_2$ of the longitudinal oloid axis 3 describe the oval curves $K_1$, $K_2$ on planes $E_1$, $E_2$ which stand upright and run in the same direction as the conveyor belt. The shape and size of these oval curves, $K_1$ and $K_2$, depend on the lateral distances of the planes $E_1$, $E_2$ from the respective edges of the conveyor belt 2.

FIG. 1*a* illustrates the three positions of the oloid 1 during a full revolution. For clarity, FIG. 1*b* illustrates the oloid 1 in only two positions, with the trace points $D_1$ and $D_2$ at the highest and lowest positions in the planes $E_1$ and $E_2$.

The movement of the trace points $D_1$, $D_2$ takes place in the same rotational pattern but basically in opposite directions.

Figure 2A:
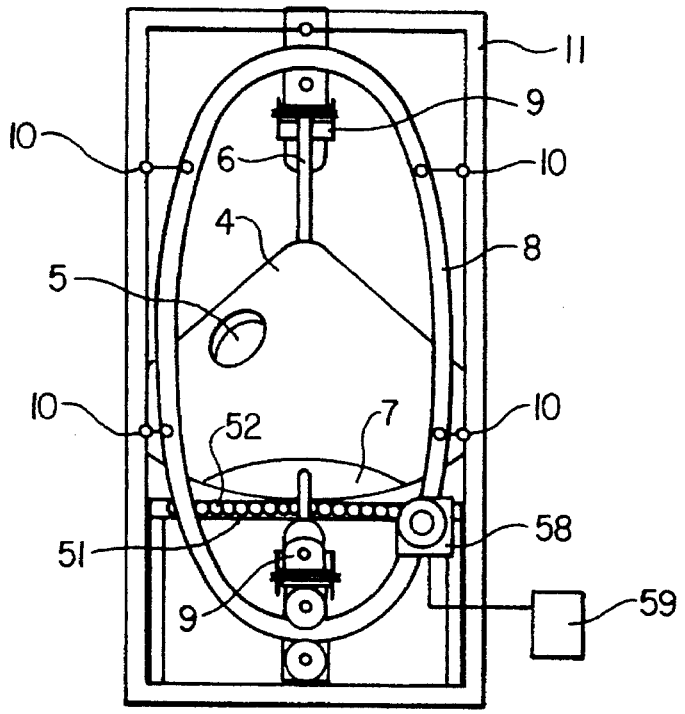
FIG. 2*a* and FIG. 2*b* are side views of one embodiment of the present invention.
Figure 2B:
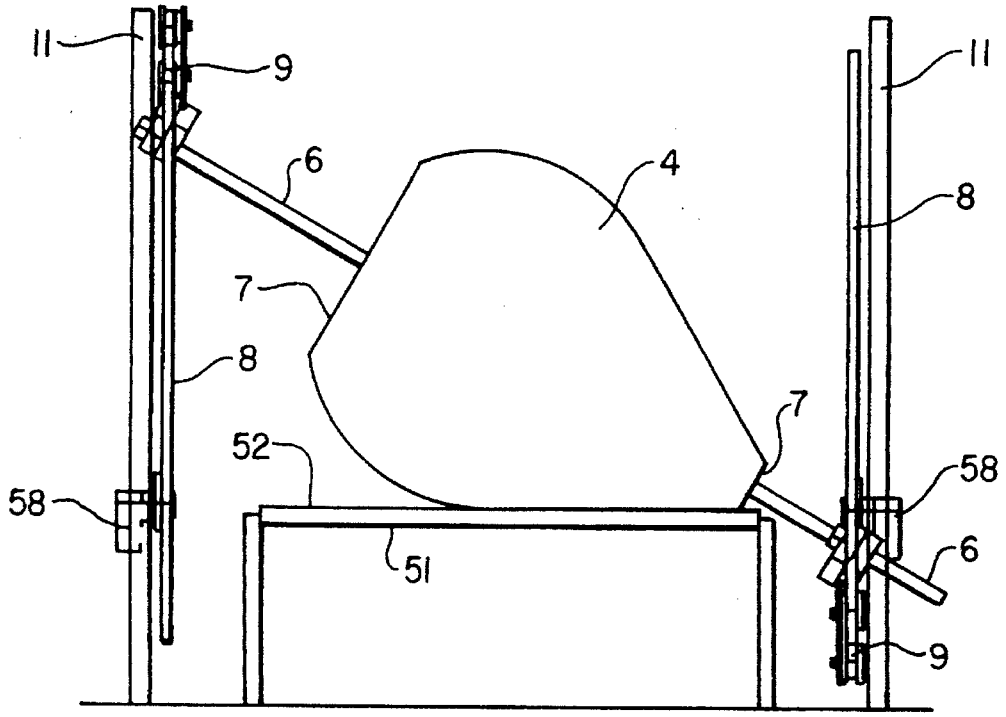

FIGS. 2*a* and 2*b* illustrate a first design version of the present invention. An oloid-shaped, hollow body 4 is positioned on a roller carpet 51. The oloid-shaped, hollow body 4 has a shaft 6 attached thereto which has the same position and direction of the longitudinal axis of the oloid shape of the hollow body 4. The shaft 6 is preferably hollow and has a passage in both ends which permit access to the oloid-shaped, hollow body 4 during movement of the oloid shaped, hollow body 4 for the addition and removal of materials and for the introduction of probes. The oloid-shaped, hollow body 4 can be a mixing vessel and have a closeable opening 5. The roller carpet 51 consists of several short, freely moveable rollers 52 with rotary axes which are parallel to each other and that are perpendicular to the drawing plane of FIG. 2*a* and parallel to the one in FIG. 2*b*. The roller axes are, thus, perpendicular to the planes $E_1$, $E_2$. The direction of these planes $E_1$, $E_2$ can be referred to as the direction of movement for the tumbler body. Both ends of this hollow body 4 slightly deviate from the oloid shape in such a way that a segment has been cut off, thereby creating planer areas 7. This slightly reduces the contact line on the roller carpet 51 in the two extreme positions of the hollow body 4. Thus, the roller carpet 51 can be designed narrow enough to allow for the shaft 6 to protrude on the sides. According to this invention, a conveyor belt 2 can be used instead of the roller carpet 51 with the conveyor belt 2 being moved as is the case for the roller carpet 51. This design variation also applies to the second design variation according to FIG. 6.

The oval curves $K_1$, $K_2$ in FIG. 1*a* are integrated as oval guidance rails 8, of which only one is represented in the illustration, since they are identical if the lateral distances from the roller carpet 51 are the same and the hollow body 4 moves along the center line of the roller carpet 51. The shaft 6 is actively driven along the guiding rails 8 by means of a carriage 9, as is easily visible in FIG. 3. The carriage is only schematically illustrated in FIGS. 2*a* and 2*b* can be seen in an exploded view in FIGS. 3*a* and 3*b*. The guiding rails 8 differ in shape from the shape of the oval curves $K_1$, $K_2$ since the oval curves $K_1$, $K_2$ are valid for mathematical axes. Therefore, the distance of the rotary axis of shaft 6 from the limits of guiding rail 8 must be taken into consideration. Since small tolerances during the production of the hollow body 4 and its deformation caused by the weight of its payload have to be considered, each of the guiding rails 8 are placed in a solid frame 11 with four spring attachments 10 in such a way that the spring attachments 10 can compensate for the influence of the tolerances. However, the number four is not crucial to this invention. The device can be equipped with six or eight such spring attachments 10.

Instead of using a hollow body 4 illustrated in FIGS. 2*a* and 2*b* whose shape deviates from that of the oloid, the purpose of this invention is to adhere to the complete oloid shape and instead reduce the width of the roller carpet 51 to such an extent as is necessary to compensate for the vertical movement of the shaft 6. The active drive of the carriage 9 along the guiding rail 8 is explained in detail in FIGS. 5*a* and 5*b*. The elements referred to as numbers 58, 59 in FIGS. 2*a* and 2*b* are related.

Figure 3A:
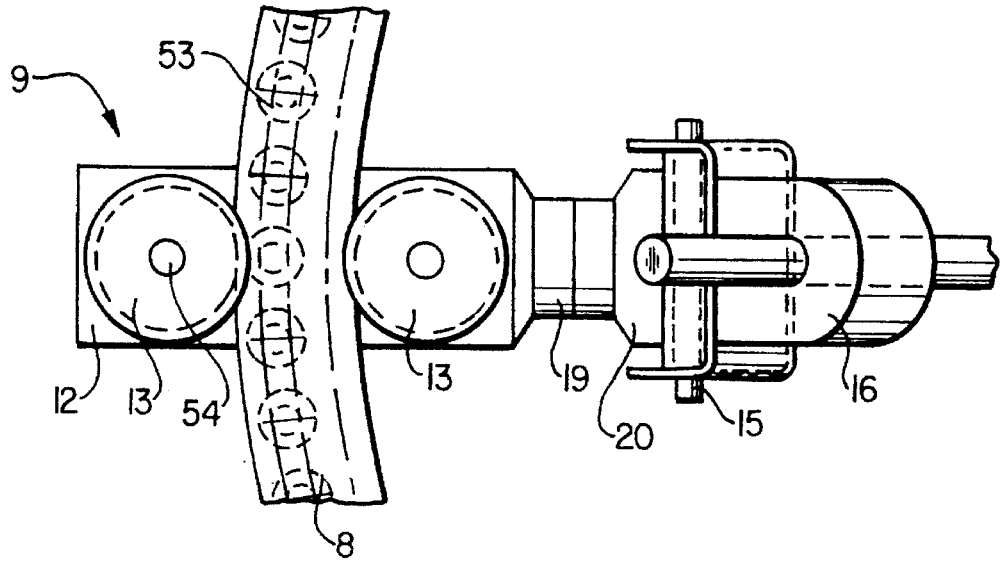
FIG. 3*a* and FIG. 3*b* are enlarged detail views from FIG. 2*a* in plan view (FIG. 3*a*) and in a partially cutaway view (FIG. 3*b*)
Figure 3B:
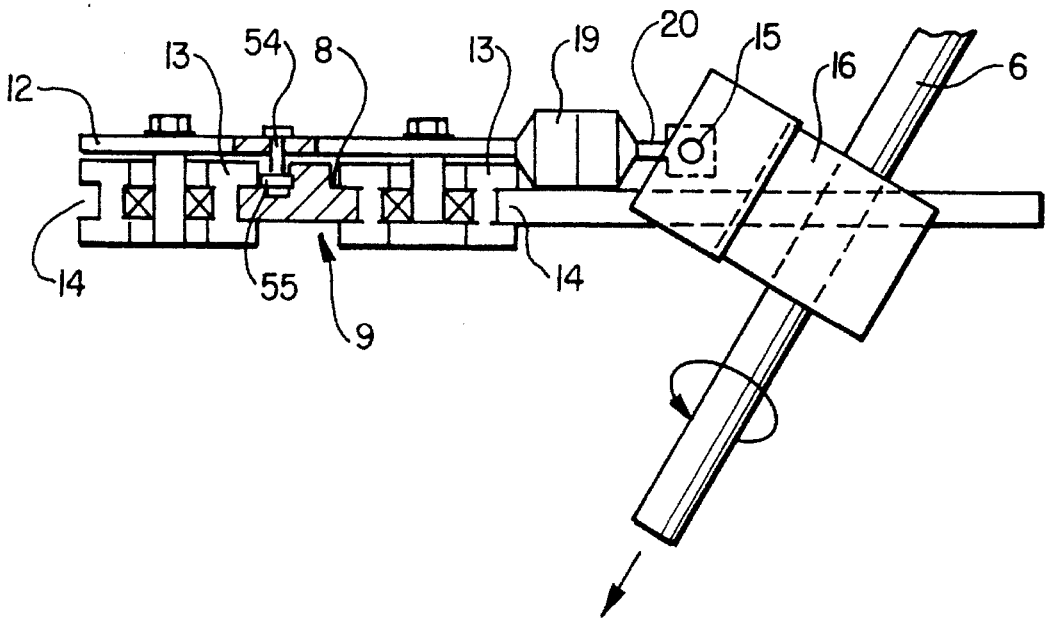

The carriage 9 is illustrated in FIG. 3*a* in a plan view, and in FIG. 3*b* in a partial cutaway view. The carriage 9 consists of a frame 12 that houses two guiding wheels 13 with grooves 14 that could be equipped, for example, with ball bearings. The carriage 9 embraces the guiding rail 8. Therefore, the carriage 9 can only move in the plane defined by the guiding rail 8. The frame 12 houses a pivot 19 against the curving inside of the guiding rail 8, whose rotary axis is perpendicular to the tangent at the guiding rail 8. A pivoting plate 20 is attached to the frame 12 by means of the pivot 19. This plate 20 carries a cross axis 15 that allows for the placement of a traversable guiding element 16. The cross axis 15 is perpendicular to the pivot axis 19 and has the same direction as the tangent at the guiding rail 8.

The shaft 6 is mounted in the guiding element 16 in such a way that it can be turned and moved to the side, as indicated by the arrows in FIG. 3*b*.

Figure 4:
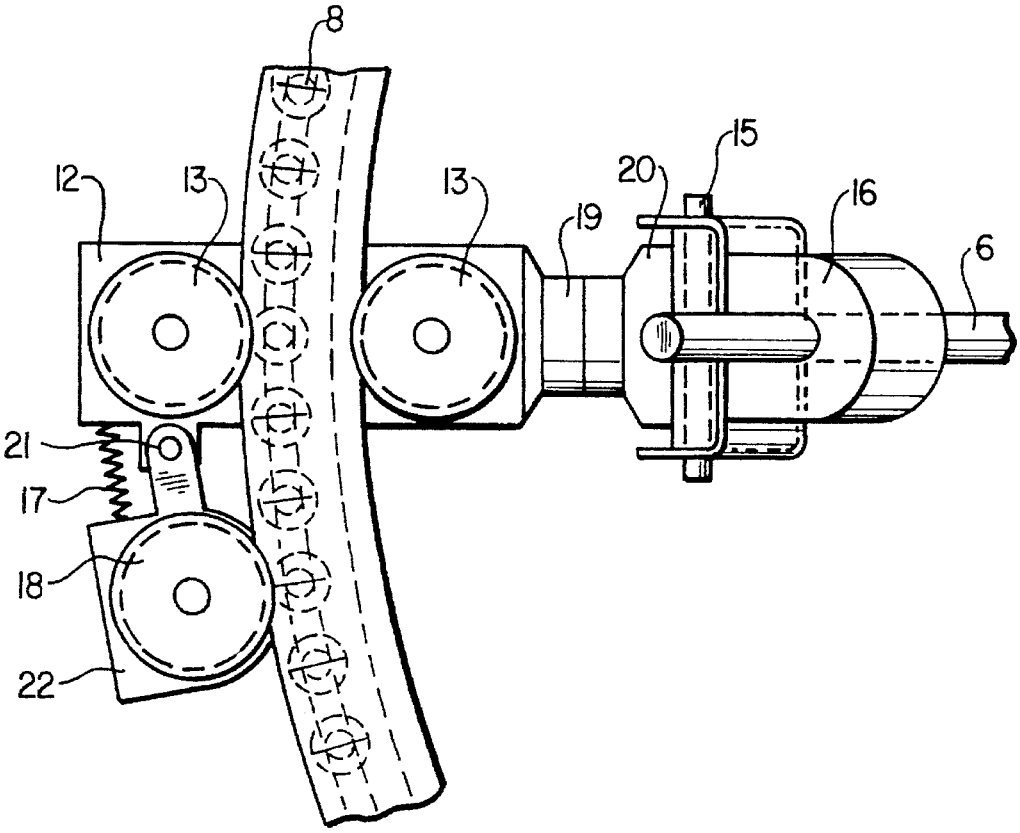
FIG. 4 is a variation of the carriage of FIG. 3*a;*

A roller chain 53 runs in the guiding rail 8, whose cross-section is illustrated in FIG. 3*b*. The carriage 9 is driven by the roller chain 53. Therefore, the frame 12 of the carriage 9 is connected to the axis of a roll 55 in the roller chain 53 by means of a pin 54, or the like. FIG. 4 illustrates a variation of the carriage 9 shown in FIGS. 3*a* and 3*b*.

The carriage 9 in this version has a third guiding wheel that is carried by a frame segment 22 connected to the frame 12 by means of a hinge 21. The frame segment 22 is pushed away from the frame 12 by a spring 17. Thus, the third guiding wheel 18 remains in a friction-type connection with the guiding rail 8.

Figure 5A:
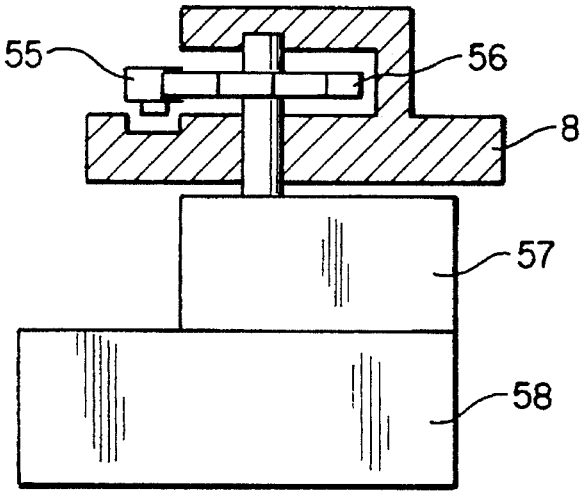
FIG. 5*a* and FIG. 5*b* are partial cutaway views of the drive unit in FIG. 2*a* and FIG. 2*;*
Figure 5B:
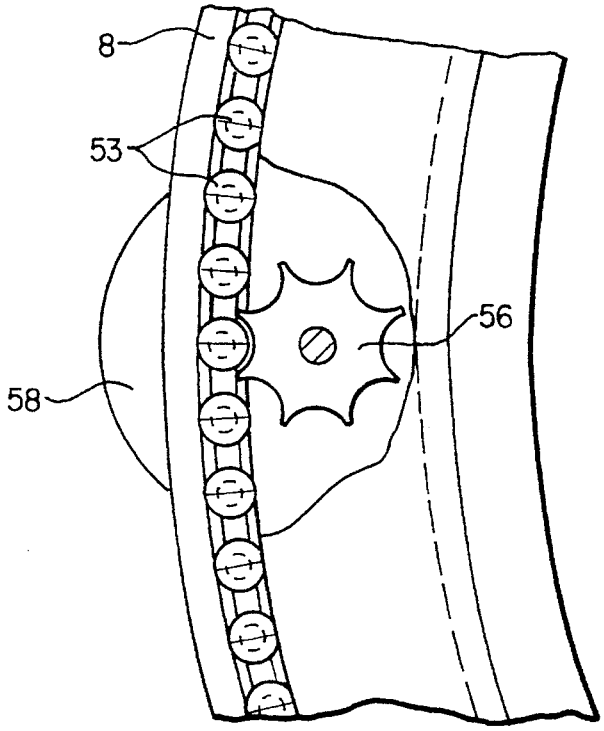

FIGS. 5*a* and 5*b* illustrate the drive of the roller chain 53 in relation to the guiding rail 8. FIG. 5*a* is a partial cutaway view and FIG. 5*b* a partially cutaway plan view. A driving gear 56 is integrated into the guiding rail 8 at a particular location, which in FIG. 2*a*, for example, is located on the lower right corner of the guiding rail 8. The driving gear 56 is driven by an engine 58 via a transmission 57. Each of the two oval guiding rails 8 carries such a drive consisting of components 56, 57, and 58. The two engines 58 are driven by a controlled power supply 59 that is schematically illustrated in FIG. 2*a*. The controlled power supply 59 maintains the sum of the driving torque for the driving engine 58 for the first end of the shaft 6 and the driving engine 58 for the second end of the shaft 6, at a constant level.

The controlled power supply 59 can be designed according to Swiss patent application 849/92-6. The position speed profiles for each of the driving gears 56 are stored in the controlled power supply 59. The engines 58 are preferably incremental engines, and are also preferably controlled by software in the controlled power supply 59, which accounts for the non-uniform movement of the carriage 9.

Thus, the position-speed profile of the engine 58 can be permanently stored in the numerically controlled power supply 59. The set value/actual value comparison of the engine position is state of the art and does not have to be described in further detail.

Figure 6:
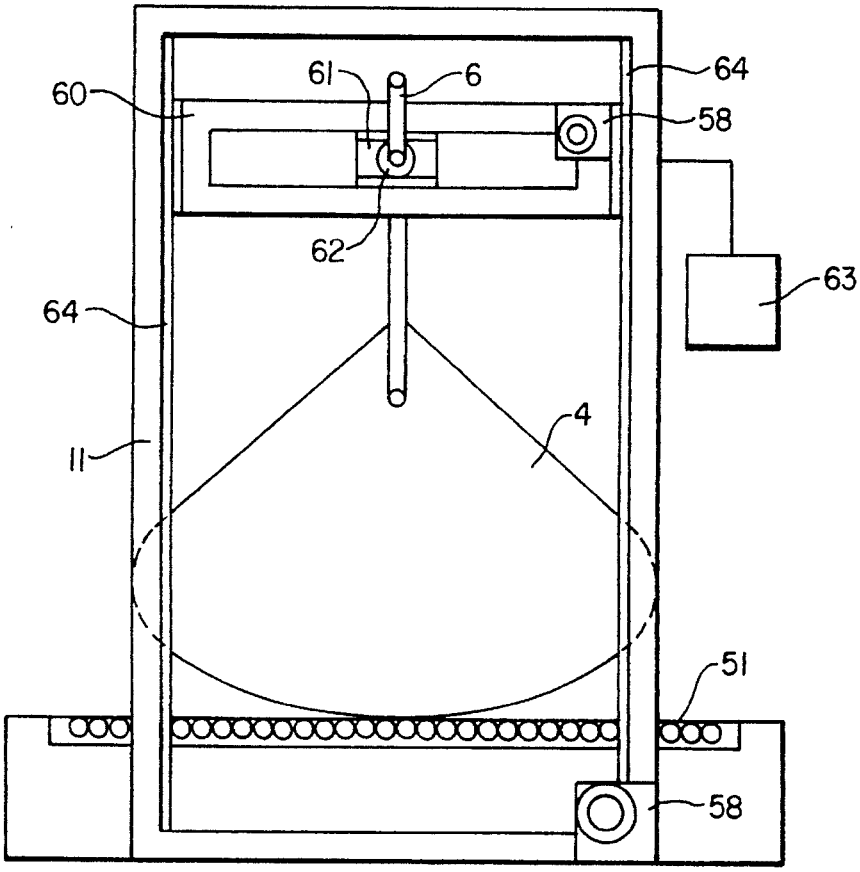
FIG. 6 is a side view of an alternate embodiment of the present invention.

In the design version according to FIG. 6, the geometric path forced by the guiding rail 8 used in the first design version is replaced by a two-coordinate control 63, comprising a vertically moveable and driven slide 60 and a horizontally moveable and driven slide 61. The slide 60 runs in a frame 11 equipped with rails 64. The slide 60 also forms the guiding element for the slide 61. The slide 61 holds a ball 62 for holding the shaft 6. The drive engines 58 for the slides 60 and 61 are powered by a control 63 that is the storage site for the position-speed profile.

The drives of slides 60 and 61 are equipped with probes to sense the actual forces applied to the shaft 6. The control 63 accommodates design and shape tolerances by modifying the profile in the control 63 based on a comparison of the actual and permissible applied forces, as is known from the field of robotics.

The hollow body 4 runs on the roller carpet 51, as is also the case in the first design version. A variation (not illustrated) to the first and second design versions, is a freely moving conveyor belt running on two rollers that replaces the roller carpet 51. There are, of course, two frames 11 with rails 64, slides 60 and 61 with ball 62—similar to the first design version according to FIGS. 2*a* and 2*b*—with one frame 11 attached to each side of the roller carpet 51.

During operation, the slides 60 and 61 for each frame 11 move basically in opposite direction to give the shaft 6 a motion that will cause a tumbling of the hollow body 4.

Figure 7A:
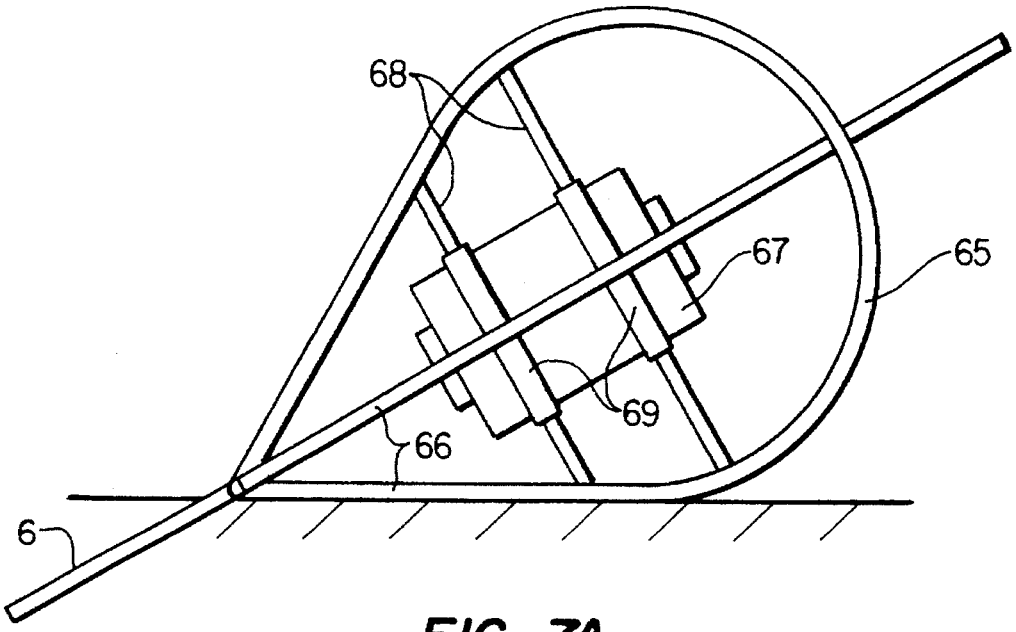
FIG. 7*a* and FIG. 7*b* are plan and cutaway views, respectively, of a variation of a component.
Figure 7B:
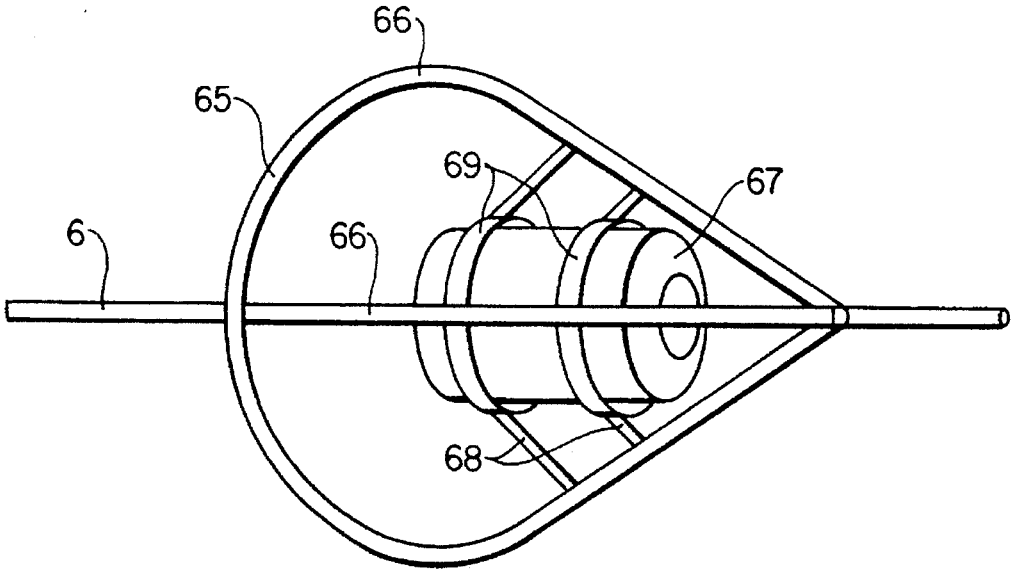

As illustrated in FIGS. 7*a* and 7*b* in plan and cutaway view, a skeleton body 66 with an exterior shape of an oloid and partially made of arcuate rods 65 executes the same motion as the described hollow body 4. This allows for the attachment of a simply-shaped vessel 67, for example, a commercial chemical drum by the use of rods 68 and belts 69 on the inside of the skeleton body 66.

As mentioned above, the shaft 6 can be hollow. This makes the inventive device also suitable for the mixing of liquid and solid materials in a flow process. Therefore, both ends of the shaft 6 are equipped with a known rotary passage. Such passages allow for the addition of several components. Moreover, it allows easy access for probes measuring pressure, temperature, pH, and other parameters.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

I claim:

1. A device comprising:

a passively driven base;

a tumbler body having a shape of an oloid and a longitudinal axis, said tumbler body being positioned on said passively driven base;

a shaft attached to said tumbler body, said shaft having the same position and direction as the longitudinal axis of said tumbler body, said shaft further having a first and a second end;

means for guiding the first end of said shaft in a first oval path, the first oval path being in a first plane perpendicular to said passively driven base, and means for guiding the second end of said shaft in a second oval path, the second oval path being in a second plane parallel to said first plane and perpendicular to said passively driven base; and means for driving the first end of said shaft along the first oval path, and means for driving the second end of said shaft along the second oval path.

2. The device as set forth in claim 1, wherein said passively driven base comprises a roller carpet having a plurality of rollers with axes which are parallel to each other and perpendicular to the first plane and the second plane.

3. The device as set forth in claim 1, wherein said passively driven base comprises a horizontal, freely movable conveyor belt.

4. The device as set forth in claim 1, wherein said tumbler body is a closed hollow tumbler body.

5. The device as set forth in claim 4, wherein said closed hollow oloid shaped tumbler body further includes a first planar end and a second planar end, the first and second planar ends each extending radially from said longitudinal axis.

6. The device as set forth in claim 4, wherein said shaft is hollow and has a passage at the first end and the second end, thereby permitting access to said tumbler body during movement of said tumbler body for the addition and removal of materials and for the introduction of probes for testing during movement of said tumbler body.

7. The device as set forth in claim 1, wherein said tumbler body comprises a skeleton body having arcuate rods shaped to have an exterior shape of an oloid.

8. The device as set forth in claim 7, wherein said tumbler body further includes means for attaching a vessel to the inside of the skeleton body.

9. The device as set forth in claim 1, wherein said shaft is hollow and has a passage at the first end and the second end, thereby permitting access to said tumbler body during movement of said tumbler body for the addition and removal of materials and for the introduction of probes.

10. The device as set forth in claim 1, wherein said means for guiding the first end of said shaft and said means for guiding the second end of said shaft each include:

a frame;

an oval guidance rail having a roller chain path;

a plurality of spring attachments, each of said spring attachments securing said oval guidance rail to said frame;

a carriage, said carriage having at least two wheels rotatably attached to a carriage frame, the at least two wheels being positioned to rotate in the same plane and to hold the oval guidance rail therebetween; and a guide element swivelly and rotatably attached to said carriage, wherein said guide element swivels about an axis in the same plane as the at least two wheels of said carriage and perpendicular to said oval guidance rail and rotates about an axis perpendicular to the axis of swivel, and wherein said shaft is slidably and rotatably connected to said guide element with respect to the longitudinal axis of said tumbler body;

and wherein said means for driving the first end of said shaft and said means for driving the second end of said shaft each include:

a roller chain comprising a plurality of rollers running around the roller chain path in said oval guidance rail, wherein said carriage is secured by a pin to one of the plurality of rollers of said roller chain;

a drive comprising a drive gear driven by an engine via a transmission, wherein the drive gear of said drive moves said roller chain through the roller chain path in said oval guidance rail;

and wherein said device further comprises a controlled power supply, said controlled power supply driving the engine of said means for driving the first end of said shaft, and driving the engine of said means for driving the second end of said shaft.

11. The device as set forth in claim 10, wherein said controlled power supply maintains the sum of the driving torque for the engine of said means for driving the first end of said shaft, and the driving torque for the engine of said means for driving the second end of said shaft, at a constant level.

12. The device as set forth in claim 10, wherein position speed profiles for each of said drive gears are stored in said controlled power supply.

13. The device as set forth in claim 10, wherein said tumbler body is a closed hollow tumbler body.

14. The device as set forth in claim 13, wherein said closed hollow oloid shaped tumbler body further includes a first planar end and a second planar end, the first and second planar ends each extending radially from said longitudinal axis.

15. The device as set forth in claim 13, wherein said shaft is hollow and has a passage at the first end and the second end, thereby permitting access to said tumbler body during movement of said tumbler body for the addition and removal of materials and for the introduction of probes.

16. The device as set forth in claim 10, wherein said tumbler body comprises a skeleton body having arcuate rods shaped to have an exterior shape of an oloid.

17. The device as set forth in claim 16, wherein said tumbler body further includes means for attaching a vessel to the inside of the skeleton body.

18. The device as set forth in claim 10, wherein said shaft is hollow and has a passage at the first end and the second end, thereby permitting access to said tumbler body during movement of said tumbler body for the addition and removal of materials and for the introduction of probes.

19. The device as set forth in claim 1, wherein said means for guiding the first end of said shaft and the means for guiding the second end of said shaft each include:

a frame;

a vertical slide slidably connected to said frame, wherein said vertical slide slides vertically on said frame;

a horizontal slide slidably connected to said vertical slide, wherein said horizontal slide slides horizontally on said vertical slide; and a ball rotatably attached to said horizontal slide, wherein said ball rotates globally with respect to the center of said ball, and wherein said shaft is slidably and rotatably connected to said ball with respect to the longitudinal axis of said tumbler body;

and wherein said means for driving the first end of said shaft and said means for driving the second end of said shaft each include:

a vertical slide drive which drives said vertical slide vertically on said frame; and a horizontal slide drive which drives said horizontal slide horizontally on said vertical slide;

and wherein said device further comprises a control, said control storing a position speed profile and said control further driving said vertical slide drive and said horizontal slide drive for each of said means for driving.

20. The device as set forth in claim 19, wherein said tumbler body is a closed hollow tumbler body.

21. The device as set forth in claim 20, wherein said closed hollow oloid shaped tumbler body further includes a first planar end and a second planar end, the first and second planar ends each extending radially from said longitudinal axis.

22. The device as set forth in claim 20, wherein said shaft is hollow and has a passage at the first end and the second end, thereby permitting access to said tumbler body during movement of said tumbler body for the addition and removal of materials and for the introduction of probes.

23. The device as set forth in claim 19, wherein said tumbler body comprises a skeleton body having arcuate rods shaped to have an exterior shape of an oloid.

24. The device as set forth in claim 23, wherein said tumbler body further includes means for attaching a vessel to the inside of the skeleton body.

25. The device as set forth in claim 19, wherein said shaft is hollow and has a passage at the first end and the second end, thereby permitting access to said tumbler body during movement of said tumbler body for the addition and removal of materials and for the introduction of probes.

* * * * *

UNITED STATES PATENT AND TRADEMARK OFFICE

CERTIFICATE OF CORRECTION

PATENT NO. : 5,492,405

DATED : February 20, 1996

INVENTOR(S) : Meyer, Pio

It is certified that error appears in the above-indentified patent and that said Letters Patent is hereby corrected as shown below:

| | |
|---|---|
| **Column 2, line 36** | Replace "FIG. 2"<br>With --FIG. 2*b*-- |
| **Column 5, line 25** | Replace "I claim:"<br>With --What is claimed is:-- |

Signed and Sealed this

Thirtieth Day of July, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,492,405

DATED : February 20, 1996

INVENTOR(S) : Meyer, Pio

It is certified that error appears in the above-indentified patent and that said Letters Patent is hereby corrected as shown below:

On the title page: Item [73] Assignee: insert "Bioengineering AG".

Signed and Sealed this

Twenty-second Day of April, 1997

Bruce Lehman

*Attest:*

BRUCE LEHMAN

*Commissioner of Patents and Trademarks*

*Attesting Officer*